US006966247B2

(12) United States Patent
Tseng

(10) Patent No.: US 6,966,247 B2
(45) Date of Patent: Nov. 22, 2005

(54) CUTTING APPARATUS

(75) Inventor: Tzu-Feng Tseng, Taipei (TW)

(73) Assignee: Primax Electronics Ltd., Taipei (TW)

( * ) Notice: Subject to any disclaimer, the term of this patent is extended or adjusted under 35 U.S.C. 154(b) by 35 days.

(21) Appl. No.: 10/697,415

(22) Filed: Oct. 30, 2003

(65) Prior Publication Data

US 2004/0194603 A1 Oct. 7, 2004

(30) Foreign Application Priority Data

Apr. 4, 2003 (TW) ..... 92107797 A

(51) Int. Cl.[7] ..... B26D 5/10; B26D 7/02
(52) U.S. Cl. ..... 83/455; 83/485; 83/614
(58) Field of Search ..... 83/455, 459, 460, 83/485, 588, 614, 452–454, 456, 464–465

(56) References Cited

U.S. PATENT DOCUMENTS

| | | | | | |
|---|---|---|---|---|---|
| 2,023,911 | A | * | 12/1935 | Boughton | 83/455 |
| 2,327,223 | A | * | 8/1943 | Silver | 83/459 |
| 2,531,149 | A | * | 11/1950 | Melchor | 83/455 |
| 3,237,497 | A | * | 3/1966 | Cook | 83/455 |
| 3,301,117 | A | * | 1/1967 | Spaulding | 83/455 |
| 3,628,412 | A | * | 12/1971 | Rogers, Jr. | 83/455 |
| 5,069,097 | A | * | 12/1991 | Mori | 83/455 |
| 5,287,783 | A | * | 2/1994 | Mori | 83/455 |
| 5,365,820 | A | * | 11/1994 | Mori | 83/455 |
| 5,524,515 | A | | 6/1996 | Boda | |
| 5,671,647 | A | | 9/1997 | Mori | |
| 6,098,515 | A | * | 8/2000 | Daley, Jr. | 83/485 |
| 6,182,549 | B1 | * | 2/2001 | Albright et al. | 83/455 |
| 2004/0226426 | A1 | * | 11/2004 | Tseng | 83/455 |

FOREIGN PATENT DOCUMENTS

| | | |
|---|---|---|
| EP | 0899067 | 8/1998 |
| JP | 2250792 | 10/1990 |

* cited by examiner

*Primary Examiner*—Stephen Choi
(74) *Attorney, Agent, or Firm*—Madson & Metcalf

(57) ABSTRACT

A cutting apparatus for cutting a sheet material includes a platform; a rail structure secured onto the platform; a sliding member sliding along the rail structure; a pressing plate disposed under the rail structure and engaging with the sliding member for pressing the sheet material against the platform in response to an external force, wherein a gap exists between the pressing plate and the platform for receiving the sheet material before the external force is exerted; an elastic member connected with and disposed between the rail structure and the pressing plate to keep the gap between the pressing plate and the platform by a recovery force thereof when the external force is released; and a cutting member carried by the sliding member for cutting the sheet material sustained on the platform.

14 Claims, 6 Drawing Sheets

CUTTING APPARATUS

FIELD OF THE INVENTION

The present invention relates to a cutting apparatus, and more particularly to a cutting apparatus for cutting papers.

BACKGROUND OF THE INVENTION

Please refer to FIG. 1 which is a schematic diagram showing the structure of the cutting apparatus in common use recently. The cutting apparatus 10 includes a rail 11 and a slider 12. The slider 12 has thereunder a cutting member such as a blade (not shown) and slides along the rail 11. The user puts one or more pieces of paper to be cut in the space under the pressing structure 110 while using the cutting apparatus. Then, the slider 12 is pressed down to make the pressing structure 110 sustain against the paper to be cut. The pressed slider 12 is movable to slide to and fro along the rail 11, thereby driving the cutting member to pass through and cut the paper.

Please refer to FIG. 2 which is a schematic diagram showing the structure of a conventional cutting apparatus, e.g. as that shown in U.S. Pat. No. 5,671,647. In FIG. 1, the base portion of the cutting apparatus is illustrated, and the elements similar to the above-mentioned ones will not be redundantly described herein. The recovery force of the spring 20 overcomes the weight of the pressing structure 110, the rail 11, and the slider 12 to sustain against the pressing structure 110 and maintain the pressing structure 110 at an initial position. Meanwhile, a gap 111 exists between the pressing structure 110 and the bed 21. After the paper to be cut is put into the gap 111, and a downward force is exerted onto the slider 12 by the user, the downward force dominates the recovery force of the spring 20. Therefore, the pressing structure 110 will move down to contact the paper and fix it. The user then moves the slider 12 to cut the paper. The pressing structure 110 will automatically move back to its initial position by the recovery force of the spring 20 while the external downward force is released.

In the prior art structure, however, too many elements are involved for fixing, cutting and releasing paper. It is troublesome to assemble these elements due to the complexity. Furthermore, since the recovery force of the spring 20 has to overcome the weight of the pressing structure 110, the rail 11, and the slider 12 to lift them, it is necessary for the spring 20 to have great durability and strength. Accordingly, it is laborious to use this cutting apparatus. In addition, an undesirable cavity is required to be provided in the structure in order to secure the spring 20. It is an object of the present invention to solve the above problems.

SUMMARY OF THE INVENTION

An object of the present invention is to provide a labor-saving cutting apparatus.

According to the present invention, there is provided a cutting apparatus, comprising: a platform for sustaining thereon a sheet material to be cut; a rail structure secured on the platform; a sliding member sliding along the rail structure; a pressing plate disposed under the rail structure and engaging with the sliding member for pressing the sheet material against the platform in response to an external force, wherein a gap exists between the pressing plate and the platform for receiving the sheet material before the external force is exerted; an elastic member connected with and disposed between the rail structure and the pressing plate to keep the gap between the pressing plate and the platform by a recovery force thereof when the external force is released; and a cutting member carried by the sliding member for cutting the sheet material sustained on the platform.

According to another aspect of the present invention, the rail structure includes: a bar serving as a track member for allowing the sliding member to slide therealong; and two supporting members, each connecting one end of the bar and the platform so as to allow the bar to suspend above the platform.

According to another aspect of the present invention, the elastic member has two ends secured to the bar and the pressing plate respectively.

According to another aspect of the present invention, the bar has a trench on a lower surface thereof and the pressing plate has a through hole.

According to another aspect of the present invention, the elastic member includes: an elastic body penetrating through the trench of the bar and the through hole of the pressing plate; an upper end has a transverse dimension greater than the width of the trench so as to engage with the bar; and a lower end has a transverse dimension greater than the width of the through hole so as to engage with the pressing plate.

According to another aspect of the present invention, the elastic member is a tension spring, a resilient slice or a rubber band.

According to another aspect of the present invention, the cutting apparatus further includes: a cover for covering the sliding member and the cutting member and receiving the external force; and a compression spring mounted between and urging against the cover and the sliding member. The sliding member is pressed down to transmit the pressing plate and the cutting member to move downwards when the external force is exerted on the cover. The pressing plate along with the sliding member is lifted up by the recovery force of the elastic member to transmit the cover and the cutting member to move upwards by the recovery force of the compression spring when the external force is released from the cover.

According to another aspect of the present invention, the sheet material is paper.

According to another aspect of the present invention, the cutting member is a rotary knife.

According to the present invention, there is provided a cutting apparatus, comprising: a platform for placing thereon a sheet material to be cut; a track member suspending above the platform; a pressing plate disposed between the track member and the platform having a gap from the platform for receiving the sheet material when the pressing plate is at an initial position, and pressing the sheet material against the platform when the pressing plate is at a wording position; a sliding member supported by the track member and engaging with the pressing plate wherein the sliding member is depressed to transmit the pressing plate from the initial position to the working position and moves along the track member in response to an external force; an elastic member disposed between and engaging with the track member and the pressing plate for recovering the pressing plate from the working position back to the initial position when the external force is released; and a cutting member carried by the sliding member to protrude from the pressing plate and pass through the sheet material to cut the sheet material.

BRIEF DESCRIPTION OF THE DRAWINGS

The present invention may best be understood through the following description with reference to the accompanying drawings, in which:

FIG. 3(*b*) is a perspective diagram showing the cutting apparatus according to the preferred embodiment of the present invention.

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only; it is not intended to be exhaustive or to be limited to the precise form disclosed.

Figure 1:
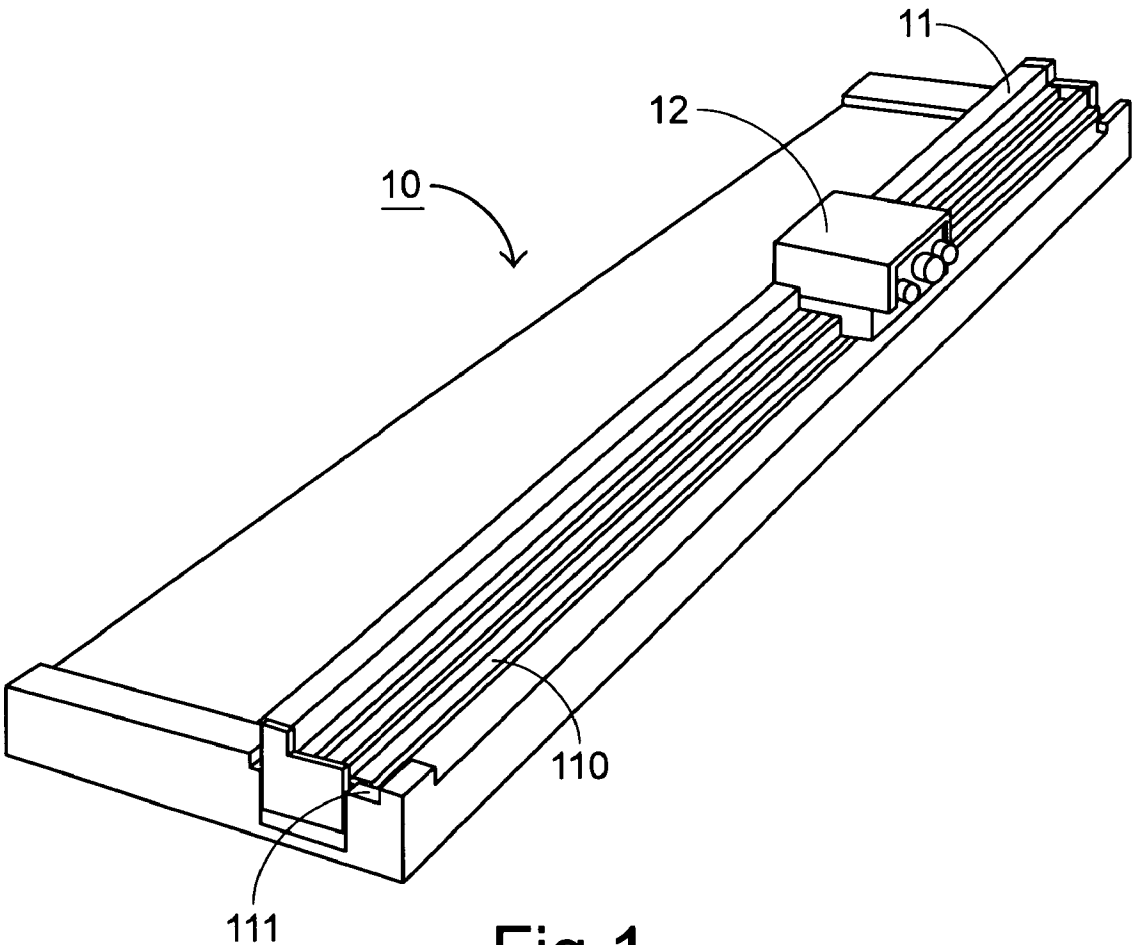
Fig.1 PRIOR ART
FIG. 1 is a perspective diagram of a conventional cutting apparatus.
Figure 2:
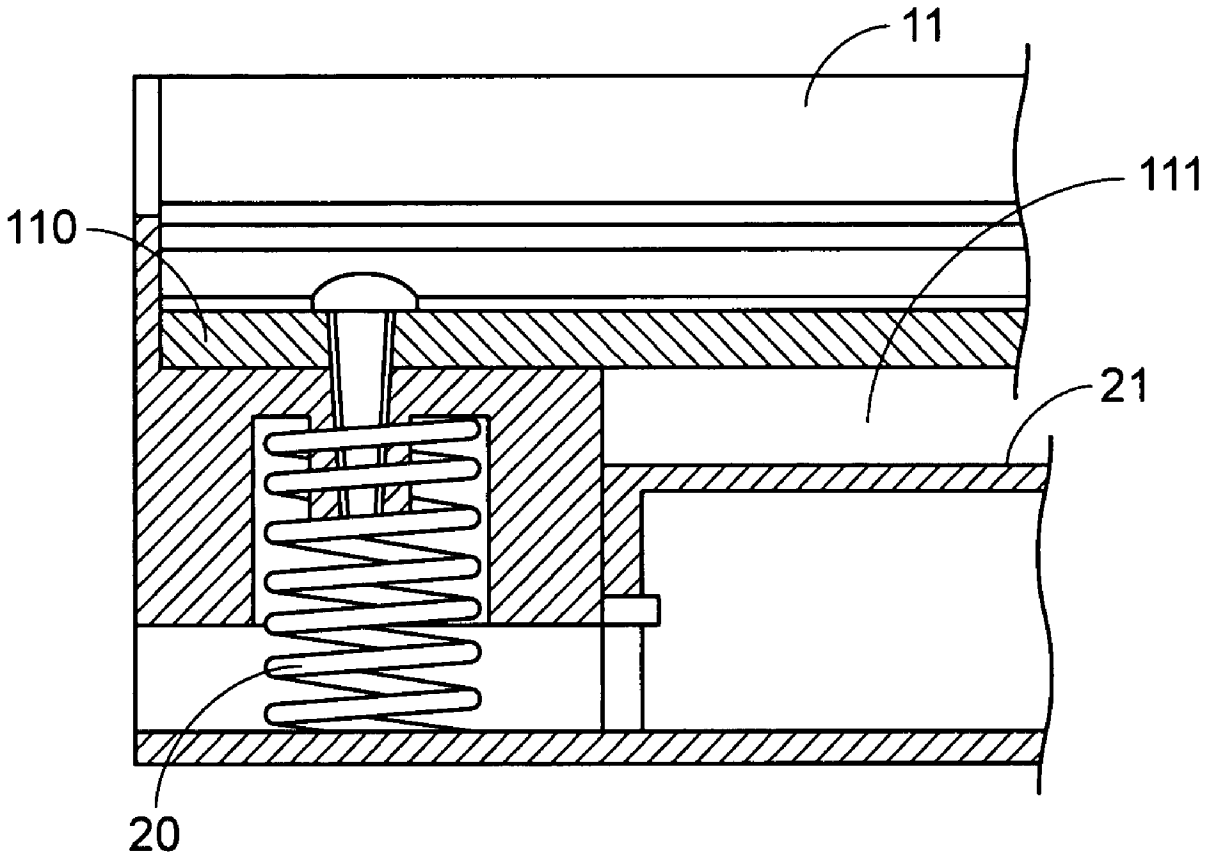
Fig.2 PRIOR ART
FIG. 2 is a cross-sectional view showing a base portion of the conventional cutting apparatus.
Figure 3A:
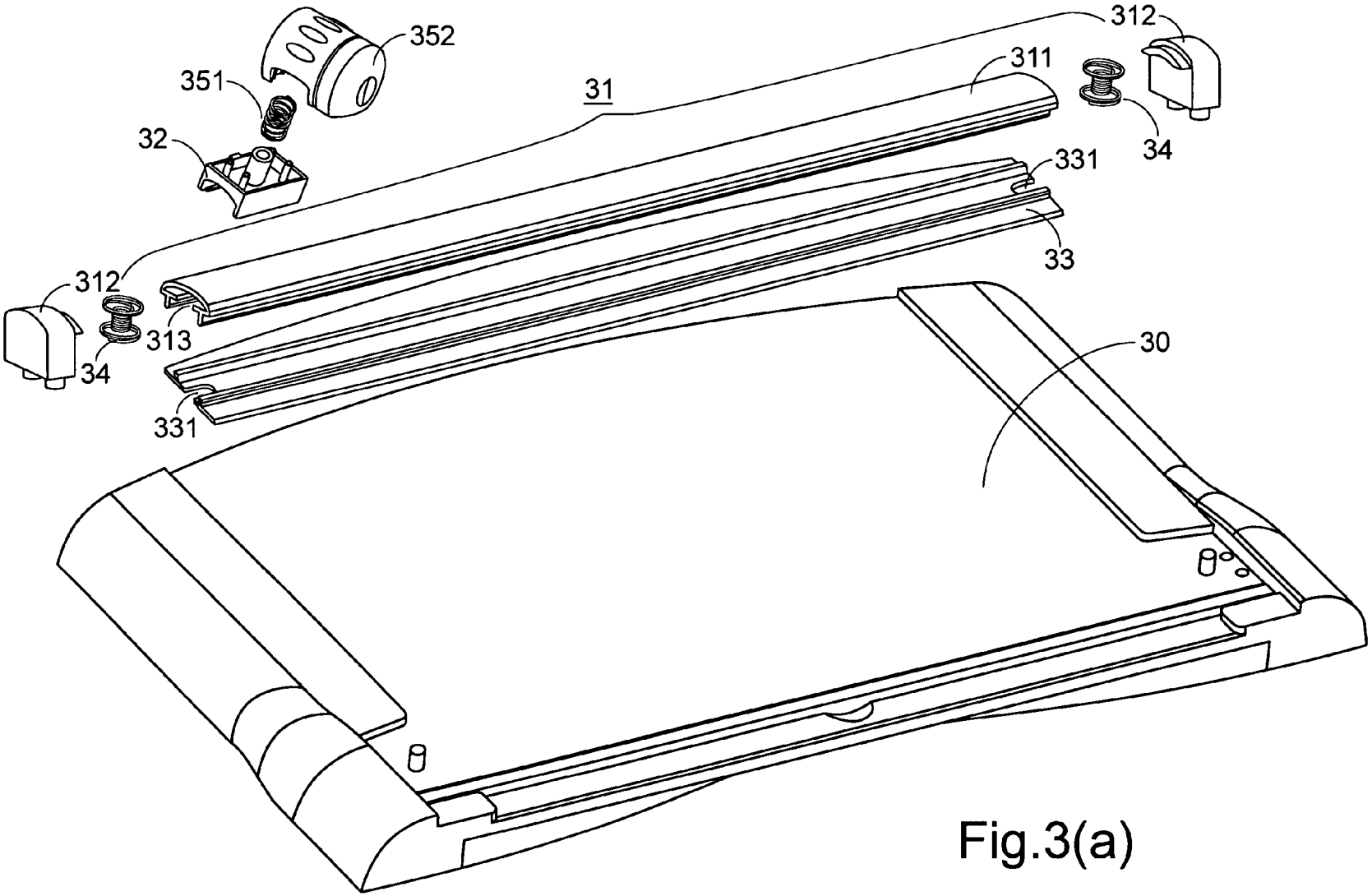
FIG. 3(*a*) is an explosive view showing a cutting apparatus according to a preferred embodiment of the present invention.
Figure 3B:
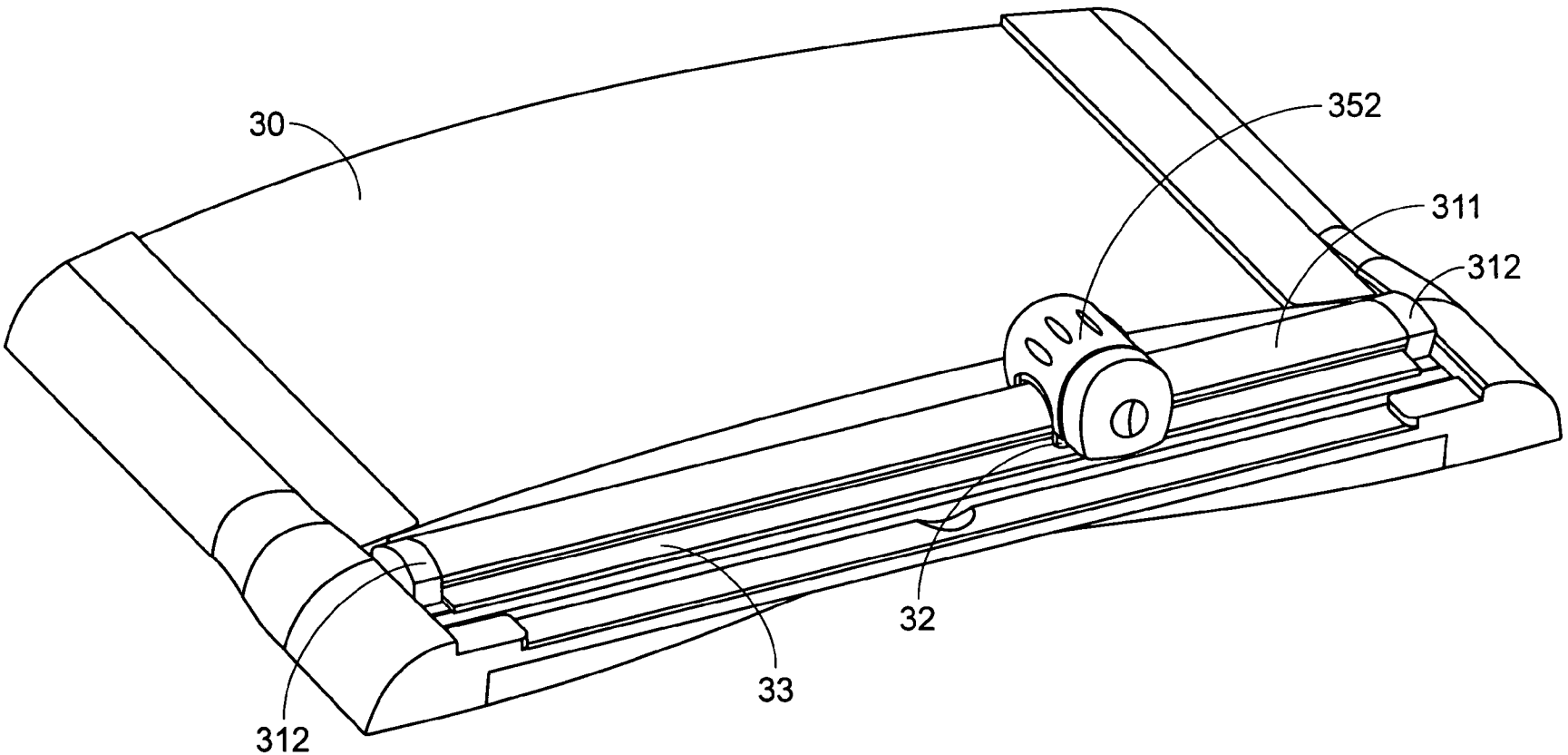

Please refer to FIGS. 3(*a*) and (*b*) which are an explosive and an assembled top perspective diagram showing the structure of a cutting apparatus according to an embodiment of the present invention. The cutting apparatus mainly includes a platform 30, a rail structure 31, a sliding member 32, a pressing plate 33, two elastic members 34, and a cutting member (not shown). The platform 30 is used to place at least one or more pieces of paper thereon. The rail structure 31 includes a track member 311, e.g. a bar, and two supporting members 312. The supporting members 312 sustain two ends of the bar 311 to suspend the bar 311 and secure it to the platform 30. The sliding member 32 is mounted on the bar 311 and movable to slide to and fro along the bar 311. The pressing plate 33 is disposed under the rail structure 31 and has a through hole 331 at each end thereof. The pressing plate 33 is used to clamp the paper with the platform 30 to assist in cutting the paper. Two elastic members 34 are inserted into the bar 311 and the through holes 331 of the pressing plate 33 to engage the bar 311 with the pressing plate 33. The cutting member hidden in the cover 352 is used to cut the paper while passing through the paper. The assembled cutting apparatus is shown in FIG. 3(*b*)

Figure 4A:
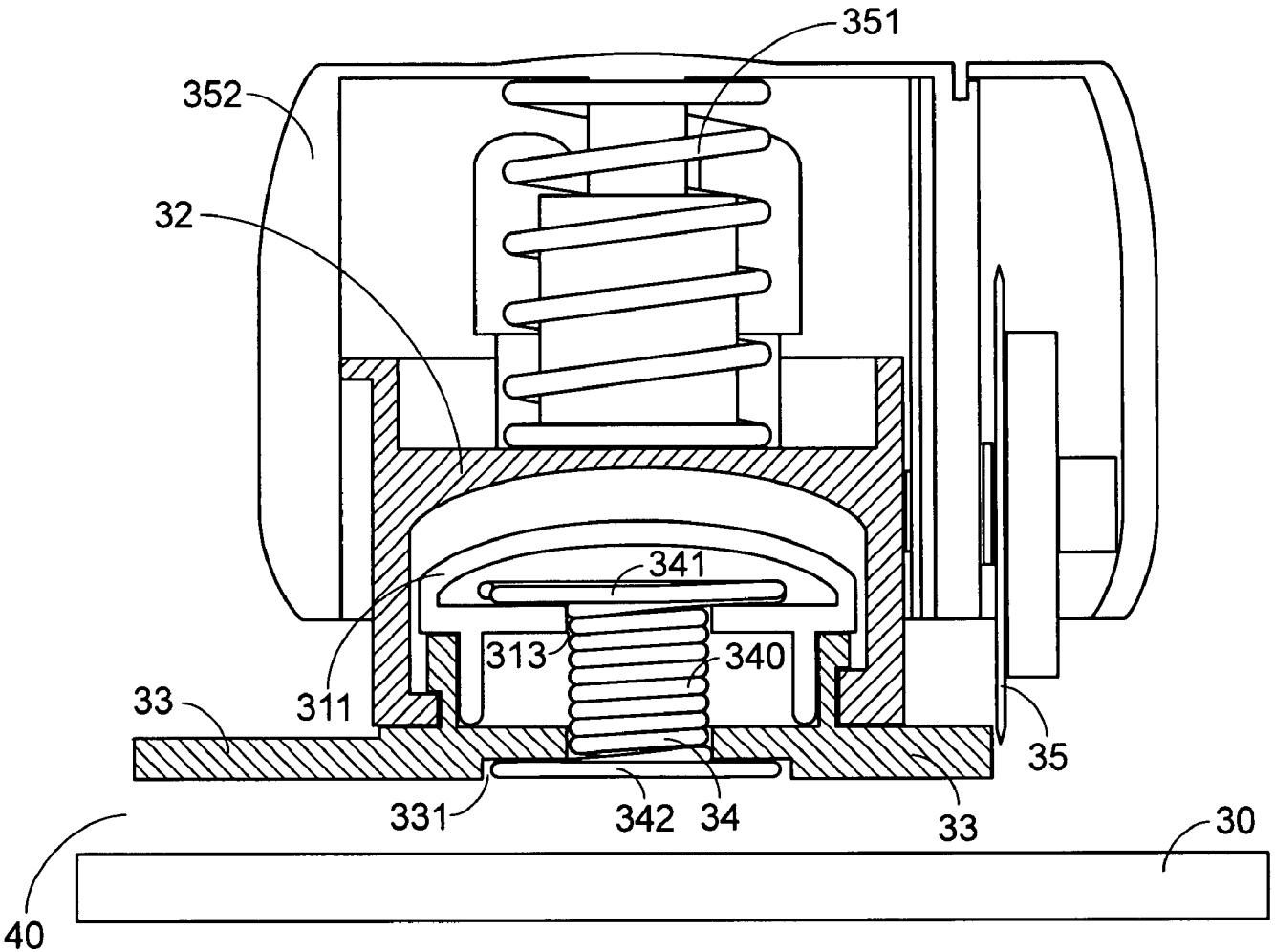
FIGS. 4(*a*) and (*b*) are cross-sectional views respectively showing the cutting apparatus in a standby state and a working state according the preferred embodiment of the present invention.
Figure 4B:
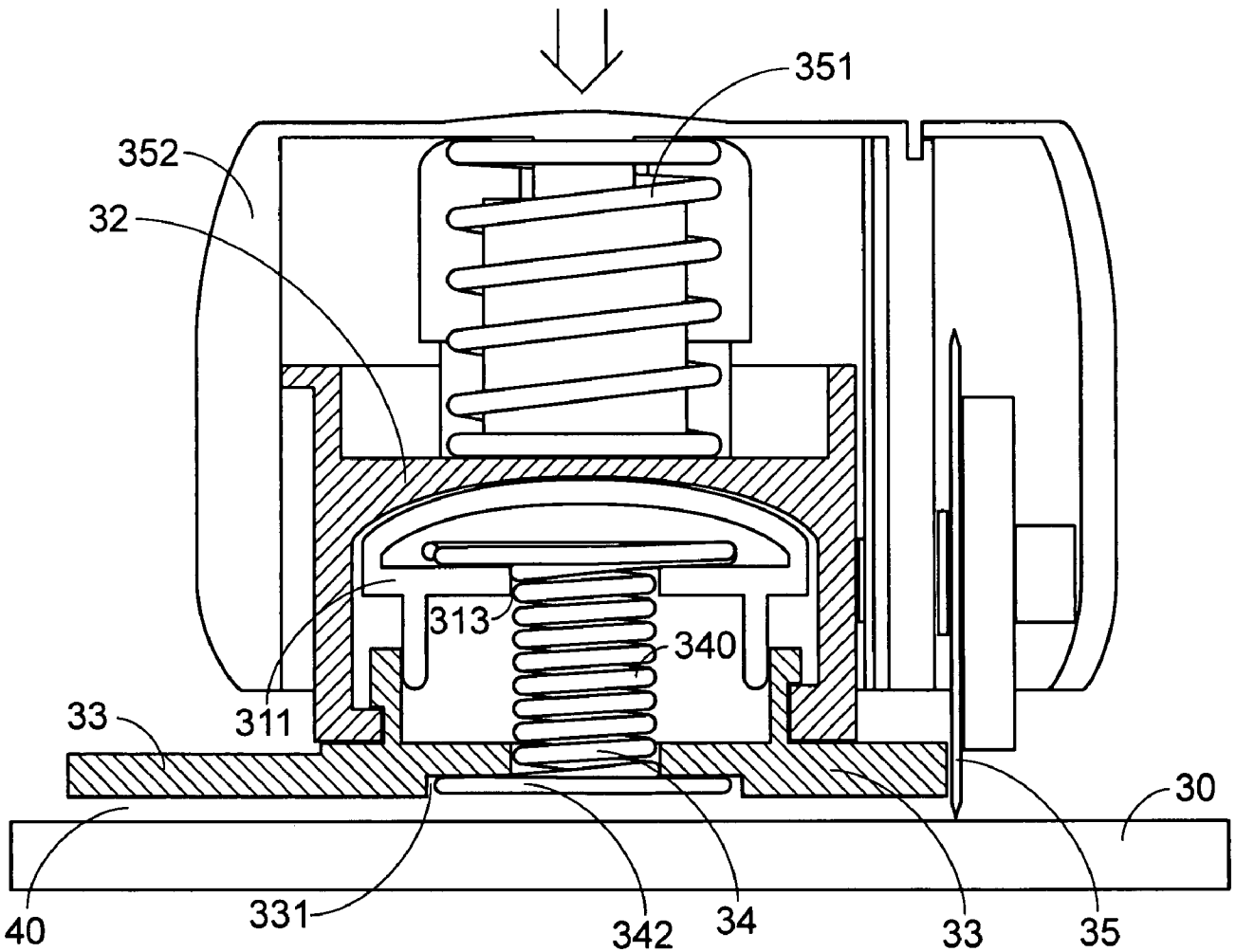

Please refer to FIG. 4(*a*) which is a cross-sectional view showing the structure at one end of the cutting apparatus in a standby state. The suspended bar 311 is at a fixed position. The pressing plate 33 is engaged with the bar by the recovery compressive force of the elastic member 34 such as a tension spring 34. The tension spring 34 has an elastic body 340, an upper end 341, and a lower end 342. The elastic body 340 penetrates through the trench 313 of the bar 311 and the through hole 331 of the pressing plate 33. The upper end 341 locks the bar 311 by a downward force of the tension spring 34 and the lower end 342 locks the pressing plate 33 by a corresponding upward force of the tension spring 34. The sliding member 32 engages with the pressing plate 33. The pressing plate 33 is lifted up by the lower end 342 of the tension spring 34 to keep a gap 40 between the pressing plate 33 and the platform 30. A compression spring 351 is provided to sustain against the cover 352 and the sliding member 32. The cutting member 35, a rotary knife for example, is fixed onto the lateral side of the cover 352. In the standby state, the rotary knife 35 does not jut out of the pressing plate 33.

A working state of the cutting apparatus will be illustrated hereinafter with reference to FIG. 4(*b*). When an external force is exerted on the cover 352 to move the cover 352 downwards, the compression spring 351 is compressed. The recovery force of the compression spring 351 urges the sliding member 32 to transmit the sliding member 32 downward. The pressing plate 33 engaging with the sliding member 32 is also pushed to clamp the paper with the platform 30. Therefore, the tension spring 34 is pulled and stretched because the downward movement of the pressing plate 33 results in downward movement of the lower end 342 of the tension spring 34. At this moment, the rotary knife 35 juts out of the pressing plate 33 to contact with the paper due to the downward movement of the cover 352 in connection therewith. By moving the cover 352 together with the sliding member 32 along the bar 311, the rotary knife 35 passes through and cuts the paper as desired.

After finishing the cutting action, the external force exerted on the cover 352 by the user is released. The cover 352 moves back to its initial position. The recovery forces of the compression spring 351 and the tension spring 34 bring the sliding member 32, the pressing plate 33, and the rotary knife 35 back to their initial positions as shown in FIG. 4(*a*).

In conclusion, the recovery force provided on the pressing plate 33 is a compressive force provided by the tension spring 34 instead of a tensile force provided by the prior compression spring. The structure is simpler and fewer components are required. The elastic member 34 just has to overcome the weight of the sliding member 32, the pressing plate 33, the cutting member 35 regardless of the weight of the bar 311. Therefore, its strength does not have to be as great as it is required in the prior art. In addition, the present invention may accomplish the objective of labor-saving. Aside from tension spring, the elastic member 34 may also be a resilient slice or a rubber band that has sufficient recovery force to lift up the pressing plate 33 together with the sliding member 32 and the cutting member 35 accompanied with the cover 352.

While the invention has been described in terms of what is presently considered to be the most practical and preferred embodiments, it is to be understood that the invention needs not be limited to the disclosed embodiment. On the contrary, it is intended to shield various modifications and similar arrangements included within the spirit and scope of the appended claims which are to be accorded with the broadest interpretation so as to encompass all such modifications and similar structures.

What is claimed is:

1. A cutting apparatus for cutting a sheet material, comprising:

a platform for sustaining thereon said sheet material;

a rail structure secured onto said platform wherein said rail structure comprises a bar having a trench on a lower surface thereof and serving as a track member;

a sliding member sliding along said bar;

a pressing plate having a through hole and disposed under said rail structure and engaging with said sliding member for pressing said sheet material against said platform in response to an external force, wherein a gap exists between said pressing plate and said platform for receiving said sheet material before said external force is exerted;

an elastic member connected with and disposed between said trench of said bar and said through hole of said pressing plate to keep said gap between said pressing plate and said platform by a recovery force thereof when said external force is released; and a cutting member carried by said sliding member for cutting said sheet material sustained on said platform.

2. The cutting apparatus according to claim 1 wherein said rail structure further comprises:

two supporting members, each connecting one end of said bar and said platform so as to allow said bar to suspend above said platform.

3. The cutting apparatus according to claim 1 wherein said elastic member has two ends secured to said bar and said pressing plate, respectively.

4. The cutting apparatus according to claim 1 wherein said elastic member comprises:

an elastic body penetrating through said trench of said bar and said through hole of said pressing plate;

an upper end has a transverse dimension greater than the width of said trench so as to engage with said bar; and a lower end has a transverse dimension greater than the width of said through hole so as to engage with said pressing plate.

5. The cutting apparatus according to claim 1 wherein said elastic member comprises a tension spring.

6. The cutting apparatus according to claim 1, further comprising:

a cover for covering said sliding member and said cutting member and receiving said external force; and a compression spring mounted between and urging against said cover and said sliding member, wherein said sliding member is pressed down to transmit said pressing plate and said cutting member to move downwards when said external force is exerted on said cover by a user, and said pressing plate along with said sliding member is lifted up by said recovery force of said elastic member to transmit said cover and said cutting member to move upwards by the recovery force of said compression spring when said external force is released from said cover.

7. The cutting apparatus according to claim 1 wherein said sheet material is paper.

8. The cutting apparatus according to claim 1 wherein said cutting member is a rotary knife.

9. A cutting apparatus for cutting a sheet material, comprising:

a platform for placing thereon said sheet material;

a track member having a trench on a lower surface thereof and suspending above said platform;

a pressing plate having a through hole and disposed between said track member and said platform, having a gap from said platform for receiving said sheet material when said pressing plate is at an initial position, and pressing said sheet material against said platform when said pressing plate is at a working position;

a sliding member supported by said track member and engaging with said pressing plate, said sliding member being depressed to transmit said pressing plate from said initial position to said working position and moving along said track member in response to an external force;

an elastic member disposed between and engaging with said track member and said pressing plate, recovering said pressing plate from said working position back to said initial position when said external force is released wherein said elastic member comprises an elastic body penetrating through said trench and said through hole; and a cutting member carried by said sliding member to protrude from said pressing plate and pass through said sheet material to cut said sheet material.

10. The cutting apparatus according to claim 9, further comprising two supporting members, each connecting one end of said track member and said platform so as to allow said track member to suspend above said platform.

11. The cutting apparatus according to claim 9 wherein said elastic member further comprises:

an upper end has a transverse dimension greater than the width of said trench so as to engage with said trench; and a lower end has a transverse dimension greater than the width of said through hole so as to engage with said through hole.

12. The cutting apparatus according to claim 9 wherein said elastic member comprises a tension spring.

13. The cutting apparatus according to claim 9, further comprising:

a cover for covering said sliding member and said cutting member and receiving said external force; and a compression spring mounted between and urging against said cover and said sliding member, wherein said sliding member is pressed down to transmit said pressing plate and said cutting member to move downwards when said external force is exerted on said cover by a user, and said pressing plate along with said sliding member is lifted up by a recovery force of said elastic member to transmit said cover and said cutting member to move upwards by the recovery force of said compression spring when said external force is released from said cover.

14. The cutting apparatus according to claim 9 wherein said cutting member is a rotary knife.

* * * * *